US011174672B2

(12) United States Patent
Sullivan

(10) Patent No.: US 11,174,672 B2
(45) Date of Patent: Nov. 16, 2021

(54) EMERGENCY ENTRY-WAY SYSTEM

(71) Applicant: Thomas P. Sullivan, Burbank, IL (US)

(72) Inventor: Thomas P. Sullivan, Burbank, IL (US)

( * ) Notice: Subject to any disclaimer, the term of this patent is extended or adjusted under 35 U.S.C. 154(b) by 65 days.

(21) Appl. No.: 16/823,256

(22) Filed: Mar. 18, 2020

(65) Prior Publication Data

US 2020/0300031 A1 Sep. 24, 2020

Related U.S. Application Data

(60) Provisional application No. 62/821,443, filed on Mar. 21, 2019.

(51) Int. Cl.

| | |
|---|---|
| ***E06B 5/16*** | (2006.01) |
| ***E06B 7/30*** | (2006.01) |
| ***E06B 7/28*** | (2006.01) |
| ***E06B 7/22*** | (2006.01) |
| ***E06B 7/23*** | (2006.01) |

(52) U.S. Cl.

CPC ..... *E06B 5/161* (2013.01); *E06B 5/16* (2013.01); *E06B 5/164* (2013.01); *E06B 7/22* (2013.01); *E06B 7/2318* (2013.01); *E06B 7/28* (2013.01); *E06B 7/30* (2013.01)

(58) Field of Classification Search

CPC . E06B 5/161; E06B 5/16; E06B 5/164; E06B 7/30; E06B 7/28; E06B 7/2318

See application file for complete search history.

(56) References Cited

U.S. PATENT DOCUMENTS

| | | | | |
|---|---|---|---|---|
| 3,051,281 A * | 8/1962 | Huff, Jr. | A62C 2/18 | 49/8 |
| 4,649,376 A * | 3/1987 | Frank | G08B 7/062 | 174/101 |
| 4,706,413 A * | 11/1987 | James | A62C 2/06 | 49/31 |
| 5,890,544 A * | 4/1999 | Love | A62C 13/78 | 169/51 |
| 6,249,221 B1 | 6/2001 | Reed | | |
| 7,204,050 B2 * | 4/2007 | Molokotos | G09F 13/04 | 292/93 |

(Continued)

FOREIGN PATENT DOCUMENTS

| | | |
|---|---|---|
| CN | 103696664 B | 9/2007 |
| KR | 100587898 B1 | 6/2006 |
| KR | 100762422 B1 | 10/2007 |

*Primary Examiner* — Justin B Rephann

(74) *Attorney, Agent, or Firm* — Binita J. Singh; Bold IP, PLLC

(57) ABSTRACT

An emergency entryway system that provides for the detection of occupants in a room, fires outside of a door, and sealing the entryway during a fire emergency is disclosed. The emergency entryway system includes a door enclosed by a door frame, at least one display unit mounted in one side of door and at least one camera mounted in the door frame on the opposite side of the door, whereby the display unit in the door displays an image transmitted from the camera from the other side of the door frame and door. The door frame of the emergency entryway system may include at least one of a smoke detector, a carbon monoxide detector, or a radon detector, at least one fire extinguisher, an oxygen sensor, an alarm, a gas inflator canister, and an inflatable tubing configured to seal a space between the door and the door frame during a fire emergency.

20 Claims, 2 Drawing Sheets

(56) References Cited

U.S. PATENT DOCUMENTS

| | | | | |
|---|---|---|---|---|
| 7,339,488 | B2 * | 3/2008 | Pennington | G08B 5/36 340/628 |
| 7,528,700 | B2 * | 5/2009 | Picard | G08B 7/062 340/286.05 |
| 8,595,983 | B2 * | 12/2013 | Gaviglia | E06B 7/2318 49/477.1 |
| 2003/0024184 | A1 * | 2/2003 | Orr, Jr. | E06B 5/164 52/211 |
| 2006/0260196 | A1 * | 11/2006 | Cheng | E06B 7/30 49/171 |
| 2010/0174401 | A1 * | 7/2010 | Giacosa | E06B 7/2318 700/213 |
| 2015/0376923 | A1 * | 12/2015 | Presutti | E05C 19/005 49/506 |

* cited by examiner

EMERGENCY ENTRY-WAY SYSTEM

CROSS REFERENCE TO RELATED APPLICATIONS

This application claims the benefit of U.S. Provisional Application No. 62/821,443 filed on Mar. 21, 2019, which is incorporated by reference in its entirety.

TECHNICAL FIELD

The disclosure relates generally to the field of emergency entryways, and more specifically, to an emergency entryway system for fire and room occupant detection.

BACKGROUND

Even with modern technology and advancements in fire safety, it remains difficult for emergency services and rescuers to determine if occupants are inside of certain rooms in a burning building or house. Further, it also remains difficult for occupants inside of a room in a burning building with a closed door to determine whether the other side of the door is free of a fire hazard. Typically, firefighters must search every room in a burning house or building in order to determine if it is free of occupants. Occupants of rooms often must physically feel their doors to determine if it is hot or if a fire is on the other side. Also, small children do not have the capability to understand that there may be a fire outside of the room they are trying to escape.

There have been many attempts to solve the problems in the prior art including systems that include sensors to detect smoke and carbon dioxide, emergency sprinklers, automatic fire extinguishers built into doors, as well as different types of cameras and heat sensors to detect a fire.

However, many of the existing systems rely on sensors to detect a fire hazard and do not give more detailed information such as occupancy of a room as well as specific fire information. Further, many fire detection systems are centrally located and are not capable of giving an occupant of a room fire hazard information more complex than an alarm. Also, there are no means specifically designed for children to determine an emergency outside of a room they are occupying.

Therefore, fire hazard emergency personnel must spend significant time searching all the rooms of a building during a fire emergency in order to determine if everyone is safe from a fire hazard.

Thus, a way to quickly determine if a room is occupied during a fire emergency as well as letting occupants know if the entryway is safe of a fire hazard is desired.

The disclosed system is directed to overcoming one or more of the problems set forth above.

SUMMARY

The disclosure presented herein relates to a system for an emergency entryway system that provides for detecting occupants in a room, a fire outside of a door, and sealing the entryway during a fire emergency. The emergency entryway system includes a door which is enclosed by a door frame in which the door has a first side which faces out from a first side of the door frame and a second side which faces out from a second side of the door frame. The emergency entryway system includes at least one display unit mounted in the first side of the door and at least one camera mounted in the second side of the door frame, such that the display unit in the first side of the door displays an image transmitted from the camera on the second side of the door frame. The door frame of the emergency entryway system may include at least one of a smoke detector, a carbon monoxide detector, or a radon detector, at least one fire extinguisher, an oxygen sensor, an alarm, a gas inflator canister, and an inflatable tubing configured to seal a space between the door and the door frame during a fire emergency.

In one embodiment, the emergency entryway system provides one or more displays in the outside of a door that allows emergency personnel to view into a room on the inside of the door via a camera in the inside of a door frame to see if any occupants are inside the room during a fire emergency situation.

In a further embodiment, the emergency entryway system provides one or more displays in the inside of a door that allows occupants in a room to view outside the room via a camera in the outside of a door frame to see if there is a fire outside of the room.

In another embodiment, the emergency entryway system provides for displays on both sides of a door and cameras on both sides of a door frame to allow viewing into the room from outside the room along with viewing outside the room from inside the room.

In one embodiment, a display on a door is positioned in the upper portion of the door to readily provide viewing of the display by an adult. Additionally, one or more displays may be positioned in the lower portion of the door to readily provide viewing of the display by a child, particularly with respect to the inside of the door so that a child can see on the display whether there is a fire outside the door. The display screen for the child may also include audible instructions for the child.

The presently disclosed emergency entry-way system is further described in the attached drawings and detailed description below.

DETAILED DESCRIPTION

Figure 1:
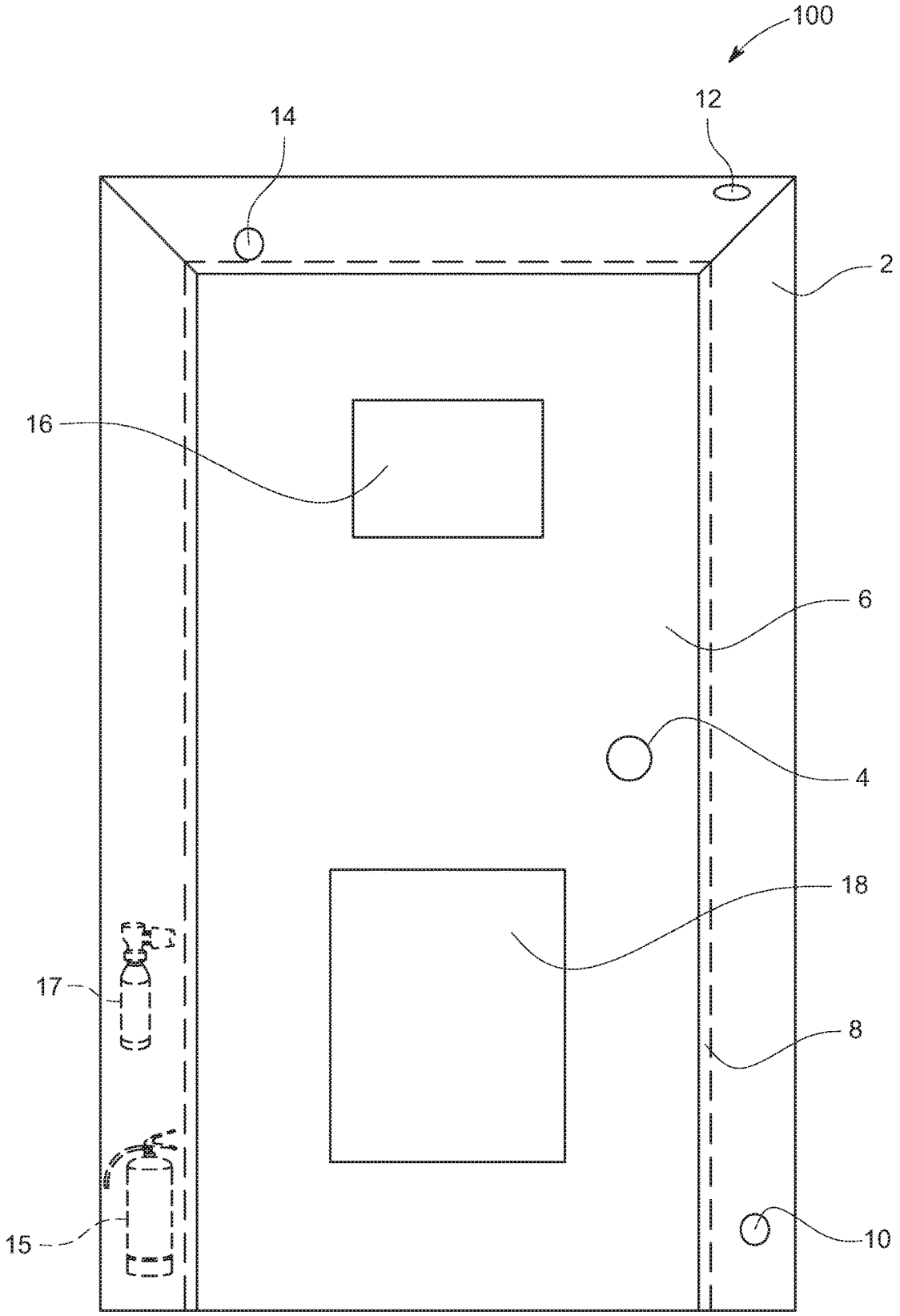
FIG. 1 depicts a front view of an exemplary emergency entryway system according to various aspects of the present disclosure.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

The following description provides preferred exemplary embodiments only, and is not intended to limit the scope, applicability, or configuration of the invention. The following description of the preferred exemplary embodiment will provide those skilled in the art with an enabling description for implementing a preferred exemplary embodiment of the invention. It being understood that various changes may be made in the function and arrangement of elements without departing from the scope of the invention as set forth in the claims.

The presently disclosed system includes one or more embodiments for various emergency entryway systems that may be used in an emergency, such as a fire emergency, to provide a method for detecting occupants in a room, for occupants within a room to determine whether there is a fire outside the room, and also for sealing the space between a door and a door frame to prevent noxious gases and smoke from entering the room. A door and a door frame form the basis of the emergency entryway system. The door and door frame may be fashioned from any material known in the art to make doors and door frames and may also include materials that make the door and door frame fire resistant.

The door may be constructed to include one or more display units or screens, and one or more cameras that transmit a feed to the display units/screens. One or more display screens may be assembled on the door facing the inside of a room with one or more cameras assembled on the door or door frame facing the outside of the room providing an image to the inside display. In this manner, an occupant in a room may look at the screen to see if there is a fire on the other side of the door. Additionally, one or more display screens may be assembled on the door facing the outside of a room and one or more cameras assembled on the door or door frame facing the inside of a room such that emergency personnel or another individual may look at the screen to detect occupants in a room during a fire or other emergency. The one or more cameras on the inside may be connected to the one or more screens on the outside.

In one or more embodiments, an entryway system may utilize various cameras including but not limited to a regular camera, a thermal camera, or a combination of different types of cameras. The entryway system, in one or more embodiments, may have a low mounted screen on the inside facing door that would allow for easy access of the view to the outside of a room by a child. The screen may also include instructions for the child during an emergency.

In one or more embodiments, an entryway system may be modeled to include one or more devices for various methods for detection of a fire or other emergency. These devices may include but are not limited to a smoke detector, a carbon monoxide detector, an oxygen sensor, poison gas readout, a radon detector, and any other detector or sensor commonly used to detect signs of a fire emergency. These detection methods may be included on the door frame. An audible alarm circuitry may also be connected to the detectors and sensors such as to present an audible warning of an emergency when one of the detectors or sensors detects a threshold amount of the relevant stimulant.

In case of a fire emergency, within the door frame is provided a fire extinguisher which is accessible to a person inside the room or outside the room. The fire extinguisher is located within a hollow portion or opening of the door frame and the fire extinguisher may be accessed from the first side or the second side of the door frame through a door frame opening. The door frame opening on each of the first and second sides of the door frame is covered by a panel or door built into the door frame itself.

Preferably, a mylar inflatable tubing is included on the door frame between the door and the door frame. The inflatable tubing is capable of being inflated by a CO2 inflator, or other gas inflator. The CO2 or other gas inflator may also be included within the door frame opening. Inflating the mylar inflatable tubing seals the space between the door and the door frame so as to minimize any smoke or poisonous gas from coming into or escaping from the room during a fire emergency.

Elements included herein are meant to be illustrative, rather than restrictive. Persons having ordinary skill in the art relevant to the present disclosure may understand there to be equivalent elements that may be substituted with the present disclosure without changing the essential function or operation of the emergency entry-way system.

Figure 2:
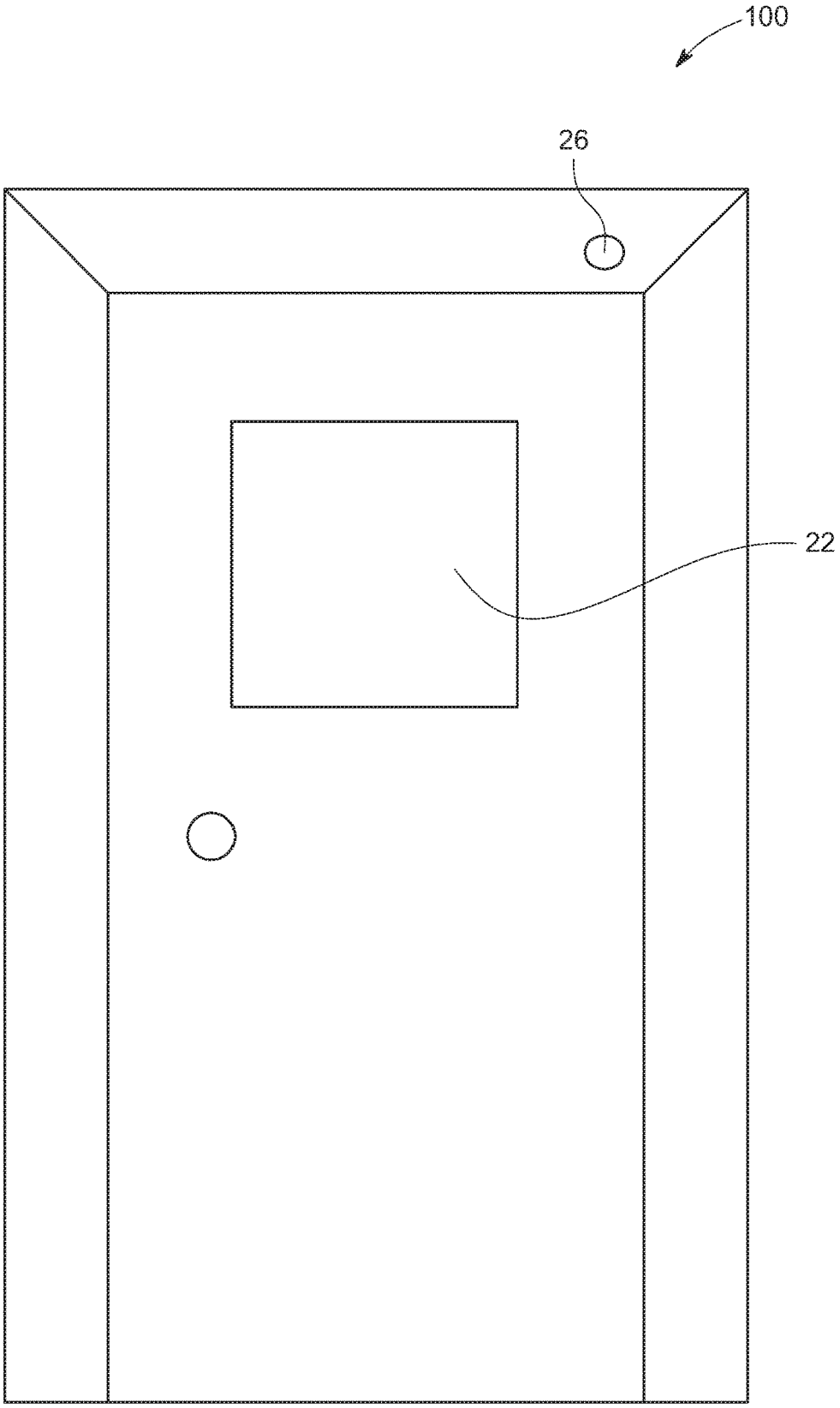
FIG. 2 is a rear view of the emergency entryway system depicted in FIG. 1

It is noted that any of the securing devices shown in FIGS. 1-2 may be formed from any suitable material, even if the cross-hatching used in any of these Figures may be illustrative of a material.

FIG. 1 and FIG. 2 depict an exemplary emergency entryway system 100. An emergency entryway system may comprise a door 6 and a door frame 2, such that the door frame 2 encloses the door 6. The door 6 may have a first side facing out from a first side of the door frame and a second side facing out from a second side of the door frame. FIG. 1 depicts a front view of an exemplary emergency entryway system 100 according to various aspects of the present disclosure. The front view may be the first side of the door 6 facing out from the first side of the door frame 2. The FIG. 1 view is a front view of the present emergency entryway system 100, as it would appear by an occupant inside a room. In the FIG. 1 embodiment, entryway system 100 includes door 6 having a door handle 4, a first display unit 16, and a second display unit 18. The emergency entryway system 100 also includes door frame 2 which may have at least one camera mounted on the first side of the door frame such as to capture a view of the inside of a room, such as first camera 14. The camera 14 can be a normal video camera or a thermal camera. The door frame may further include a gas detector 10 and a smoke detector 12. The door frame 6 may further be comprised of an opening within the door frame itself and would be such that the opening is accessible from each of the first and second sides of the door frame. The door frame opening on each of the first and second sides of the door frame may be covered by a panel or door built into the door frame itself. The door frame opening would open to a hollow section within the door frame within which may be housed a fire extinguisher 15 and a gas inflator 17. Further, between the door frame 2 and the door 6 can be an inflatable tubing 8 that is capable of creating an airtight seal between the door 6 and the door frame 2.

The door 6, in one embodiment, can be any standard door. In another embodiment, the door is a fire-resistant door, made of fire resistant or fireproof materials to prevent fire from burning the door during a fire emergency. The door frame 2 can also be any standard door frame. In another embodiment, the door frame 2 is a fire-resistant door frame, made of fire resistant or fireproof material. The door frame 2 may also include a small opening in a position that is easily accessible by an occupant. The opening may include a door that opens and closes the opening. The opening is modeled to house the sensors, detectors, inflators, fire extinguisher, and other items that may be critical in an emergency (discussed below).

The first display 16 is capable of allowing an occupant inside a room to see what is on the other side of the door 6 by way of a camera mounted on the outside of the door frame (FIG. 2 reference number 26). The camera 26 can be a normal picture camera or a thermal camera. This first display 16 gives the user live feedback of what is on the other side of the door 6 through camera 26 and allows a user to know if there is an immediate fire danger on the other side of the door 6.

The second display 18 is capable of performing the same functions as the first display 16. The second display 18 is located lower on the door 6 so as to allow a child to use it during a fire emergency. Second display 18 is also connected to the camera 26 (shown in FIG. 2). The second display 18 is also capable of providing instructions on what to do if there is a fire danger.

In some embodiments, the emergency entry-way system 100 can include an alarm (not shown in the FIGs) which is actuated by one of the system's detectors to warn an occupant that one of the system's detectors has detected signs of a fire. This alarm alerts the occupant in a room to an emergency and allows the occupants to use the first display 16 or the second display 18 to determine if there is a fire danger outside the room and if it is safe to leave the room through the emergency entryway system 100. In one embodiment, the alarm can include a variety of flashing lights, speakers, and sirens which may be located on either side or both sides of emergency entry-way system 100.

The emergency entry-way system 100 can also include a gas detector 10 and a smoke detector 12 which can be housed within the door frame 2. In other non-limiting embodiments, the gas detector and smoke detectors may also be located on the first side or second side or on both sides of the door frame 2. In further embodiments, the emergency entry-way system 100 can include detectors such as a radon detector, an oxygen sensor, a poison gas readout, or any other detector or sensor commonly used to detect signs of a fire emergency. In one embodiment, these detectors and sensors are capable of detecting signs of a fire emergency on either side of the emergency entry-way system 100.

The door frame 2 can also include an inflatable tubing 8 which may be made of mylar or similar material that is capable of being inflated by a CO2 gas inflator 17, or a gas inflator 17 that uses an alternative gas to CO2. In a preferred embodiment, when one of the gas detector 10, smoke detector 12, and/or other fire sensor/detector detects signs of a fire, the mylar tubing 8 will be automatically inflated by the inflator 17. In other embodiments, an occupant of the room may manually inflate the mylar tubing 8 by connecting the CO2 or other gas inflator 17. In either of these embodiments, inflating the mylar tubing 8 seals the space between the door 6 and the door frame 2, thus preventing poisonous gas from a fire from coming into or exiting from a room past the emergency entry-way system 100.

In one embodiment, the inflator 17 can be a CO2 or other gas inflator capable of inflating the inflatable tubing 8 made of mylar or other similar material. In other embodiments, any inflation method commonly known can be used to inflate the tubing 8.

In one embodiment, the emergency entryway system 100 can include one or more fire extinguishers 15 installed in the door frame 2. In this embodiment, the fire extinguishers 15 are capable of extinguishing a fire around the emergency entryway system, on either side, when a fire is detected by one of the above-mentioned detectors or sensors.

FIG. 2 is a rear view of the emergency entryway system 100 depicted in FIG. 1, as it would appear by an occupant or emergency personnel in a hallway outside of a room that is enterable through said emergency entryway system 100. The rear view of the emergency entryway system is the second side of the door 6 which is enclosed by the second side of the door frame 2. The embodiment in FIG. 2 shows at least one camera, such as second camera 26 which may be located on the second side of the door frame 2. The second camera 26 catches video on the outside of the door and transmits the image to the first display 16 and second display 18, which are located on the first side of door 6 (shown in FIG. 1). The second camera 26 can be a normal camera or a thermal camera. The door 2 on the second side is also comprised of a third display 22 which is connected to the first camera 14 (shown on first side in FIG. 1) such that the image captured by first camera 14 is transmitted to third display 22.

The third display 22 is to be used by occupants or emergency personnel outside of a room, in the hallway, during a fire emergency to view a live feed of camera 14, that peers into the room and is located on the first side or the front side of the door, to see if any occupants are inside the room during a fire emergency. This third display 22 enables fire fighters or any rescuers to quickly be able to look inside of a room to see if any occupants are inside when clearing a building during a fire emergency.

In another embodiment, the feed of camera 14, and in some embodiments all sensor, camera and detector data on the emergency entry-way system 100, can be accessed remotely by fire fighters or stored and accessed on one or more databases during a fire emergency to quickly determine if any occupants are inside a room. This information can be relayed to the firefighters or rescuers clearing a burning building so they do not have to waste time checking a room with no occupants.

In a further embodiment, the present emergency entryway system 100 depicted in the above disclosure can be used in a security situation. In this embodiment, the above listed cameras, or other sensors, can be used for an individual to appear inside or outside of the door, using one or more of the above-mentioned displays, to see if any trespassing individuals are on the other side of the emergency entry-way system. In this embodiment, an alarm that includes flashing lights or sirens can be used to alert the trespasser that their presence is known. Further, in one embodiment, the emergency entry-way system includes a method of contacting emergency authorities, such as calling the police or a national emergency system.

Advantageously, the present description provides one or more embodiments of various types of emergency entryway systems. Each emergency entryway system depicted herein provides advantages that overcome shortcomings of other types of entryway system and emergency fire systems (ex. fire escape doors) that are used conventionally. Further, the various embodiments shown in the Figures and described herein accommodate different sized emergency entryway systems and may be used in various applications, including but not limited to providing a fire emergency entryway system.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

The invention claimed is:

1. An emergency entryway system comprising:

a door enclosed by a door frame, the door having a first side facing out from a first side of the door frame and a second side facing out from a second side of the door frame;

at least one display unit mounted in the first side of the door and at least one camera mounted in the second side of the door frame, wherein the display unit in the first side of the door displays an image transmitted from the camera on the second side of the door frame;

the door frame comprising:

at least one of a smoke detector, a carbon monoxide detector, or a radon detector;

at least one fire extinguisher;

an oxygen sensor;

an alarm;

a gas inflator canister; and an inflatable tubing configured to seal a space between the door and the door frame during a fire emergency.

2. The emergency entryway system of claim 1, wherein the first side of the door faces into a room and the second side of the door faces outside of the room.

3. The emergency entryway system of claim 1, wherein the first side of the door faces outside of a room and the second side of the door faces into the room.

4. The emergency entry-way system of claim 1, wherein the first side of the door has a display unit that displays an image from a camera mounted in the second side of the door frame, and the second side of the door has a display unit that displays an image from a camera mounted in the first side of the door frame.

5. The emergency entry-way system of claim 1, wherein there are two displays mounted in the first side of the door with a first display mounted in a vertical center of the door below a horizontal center of the door, a second display mounted in the vertical center of the door above the horizontal center of the door; and each display shows an image from a camera mounted in the second side of the door frame.

6. The emergency entryway system of claim 1, wherein the camera is a video camera.

7. The emergency entryway system of claim 1, wherein the camera is a thermal camera.

8. The emergency entryway system of claim 1, the door frame further comprising an opening within the door frame itself, wherein the opening is accessible from each of the first and second sides of the door frame.

9. The emergency entryway system of claim 8, wherein the opening houses a fire extinguisher and a gas inflator canister.

10. The emergency entryway system of claim 8, wherein the opening on each of the first and second sides of the door frame is covered by a door built into the door frame itself.

11. The emergency entryway system of claim 1, wherein the gas inflator canister is a CO2 gas inflator canister.

12. The emergency entryway system of claim 1, wherein the door and the door frame are each made of fire-resistant material.

13. An emergency entryway system comprising:

a door enclosed by a door frame, the door having a first side facing out from a first side of the door frame and a second side facing out from a second side of the door frame;

at least one display unit mounted in the first side of the door and at least one camera mounted in the second side of the door frame, wherein the display unit in the first side of the door displays an image transmitted from the camera on the second side of the door frame;

at least one display unit mounted in the second side of the door and at least one camera mounted in the first side of the door frame, wherein the display unit in the second side of the door displays an image transmitted from the camera on the first side of the door frame;

the door frame comprising:

at least one of a smoke detector, a carbon monoxide detector or a radon detector;

at least one fire extinguisher;

an oxygen sensor;

an alarm;

a gas inflator canister; and an inflatable tubing configured to seal a space between the door and the door frame during a fire emergency.

14. The emergency entryway system of claim 13, wherein the first side of the door faces into a room and the second side of the door faces outside of the room.

15. The emergency entryway system of claim 13, wherein the first side of the door faces outside of a room and the second side of the door faces into the room.

16. The emergency entryway system of claim 13, wherein there are two displays mounted in the first side of the door with a first display mounted in a vertical center of the door below a horizontal center of the door, a second display mounted in the vertical center of the door above the horizontal center of the door; and each of the two displays show an image from a camera mounted in the second side of the door frame.

17. The emergency entryway system of claim 13, the door frame further comprising an opening within the door frame itself, wherein the opening is accessible from each of the first and second sides of the door frame.

18. The emergency entryway system of claim 17, wherein the opening houses a fire extinguisher and a gas inflator canister.

19. The emergency entryway system of claim 17, wherein the opening on each of the first and second sides of the door frame is covered by a door built into the door frame itself.

20. The emergency entryway system of claim 13, wherein the gas inflator canister is a CO2 gas inflator canister.

* * * * *